US006337447B1

(12) United States Patent
Wise et al.

(10) Patent No.: US 6,337,447 B1
(45) Date of Patent: Jan. 8, 2002

(54) ELECTRICAL DISCONNECT SWITCH ASSEMBLY

(75) Inventors: Randall D. Wise, New Ulm; Mark H. Thomson, Mankato; Daniel Ray Mertesdorf, Nicollet; Michael Tobin, N. Mankato, all of MN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/588,160

(22) Filed: Jun. 5, 2000

(51) Int. Cl.[7] ..... H01H 3/00; H01H 15/00

(52) U.S. Cl. ..... 200/17 R; 200/16 E; 200/43.05; 200/51 R

(58) Field of Search ..... 200/16 F, 16 E, 200/16 B, 51 R, 51.01, 51.12, 51.05–51.09, 51.13, 17 R, 43.01, 43.04, 43.05, 243, 284, 283, 548, 549, 573; 361/600, 641, 823, 835, 643, 837

(56) References Cited

U.S. PATENT DOCUMENTS 4,472,611 A * 9/1984 Schooh ..... 200/51 R
4,851,963 A 7/1989 Miller et al. ..... 361/356
RE34,113 E * 10/1992 Miller et al. ..... 361/356
5,272,297 A 12/1993 Reichow et al. ..... 200/549
5,406,449 A * 4/1995 Hicks et al. ..... 361/616
5,831,228 A * 11/1998 Kuki et al. ..... 200/16 E
6,118,091 A * 9/2000 Matsumoto et al. ..... 200/293

* cited by examiner

*Primary Examiner*—Michael Friedhofer
(74) *Attorney, Agent, or Firm*—Cantor Colburn LLP; Carl B. Horton

(57) ABSTRACT

An electric disconnect switch assembly mounted within a disconnect enclosure for manually disconnecting electrical equipment from a source of supply power is presented. The electric disconnect switch assembly includes a receptacle and a handle assembly. The receptacle is attached to a bottom wall of the disconnect enclosure and accepts line and load stabs and line and load terminal lugs. The handle assembly includes a handle grip projecting from one end and a line blade and a load blade slidably engaged and extending from an opposite end thereof. The handle is slidably arranged within the receptacle wherein the line blade and the load blade are moved into and out of contact with the line and load stabs by manual operation of the handle grip.

29 Claims, 4 Drawing Sheets

ELECTRICAL DISCONNECT SWITCH ASSEMBLY

BACKGROUND OF THE INVENTION

The present invention relates generally to electrical disconnects. More specifically, the present invention relates to an electrical disconnect switch assembly.

U.S. Pat. No. 4,851,963 entitled "Weatherproof Air Conditioning Disconnect Switch" describes a simple switch enclosed within a metal enclosure that includes a pull-out handle that carries the movable contacts in and out of connection with the fixed contacts arranged within the switch housing. To prevent inadvertent replacement of the handle when the air conditioning equipment is being installed or repaired, the operator may retain the handle until such repair or installation is completed.

U.S. Pat. No. 5,272,297 entitled "Streamlined Air Conditioning Disconnect Switch" describes a switch contained within a metal enclosure wherein the switch utilizes a ramped movable contact arrangement for slidably opening and closing the switch contacts without the requirement of a removable pull-out handle. A plastic faceplate covering the switch terminals allows the use of a metallic enclosure of reduced depth.

Non-automatic (manual) electrical disconnects are located near electrical equipment such as motors, compressors, motor controls or other electrically driven machinery. Electrical disconnects allow maintenance personnel to manually isolate the machinery from electrical power when maintenance or replacement of the machinery is necessary, thus protecting the personnel from electric shock.

Industrial air conditioning and refrigeration equipment, and the disconnects that service this equipment, are often located on roof tops or other outdoor locations. Consequently, the electrical disconnects must not only protect personnel from the potential hazards of electric shock, but must also be water-resistant and tamper-proof.

Electrical disconnects generally comprise a disconnect switch assembly (switch) and related connecting equipment, e.g., lugs and ground terminals, housed within a disconnect enclosure (enclosure). When the disconnect is installed, the switch is electrically connected to both the power supply (line) wiring and the equipment (load) wiring via the lugs. Thus, the switch forms part of the electrical circuit providing electrical power to the electrically driven machinery. The electric disconnect switch may operate within a metal enclosure without the requirement of circuit breakers to turn the associated electric equipment on and off.

The switches come in a variety of configurations, e.g., toggle type and pull type. The disconnects must meet accepted industry standards, e.g., Underwriters' Laboratory (UL) standards or National Electric Code standards, depending on their use. The disconnects for air-conditioning (AC) disconnects must meet Article 430 of the National Electric Code, one such industry standard.

The enclosure is generally shaped as an elongated parallelepiped, with a top wall, a bottom wall, a back wall, two side walls, and a cover.

The cover allows access to the switch and related connecting equipment housed within the enclosure. The enclosure is generally constructed of plastic or metal, and it must meet a variety of accepted industry standards, including UL standards or National Electric Code standards, depending on their use. One such standard is UL 50, entitled "Standard for Safety for Enclosures for Electrical Equipment."

The interior components of the electric disconnect, such as the handle assembly, are generally constructed of plastic materials and must comply with UL standards for strength and temperature. During production, prior art disconnects are assembled by mounting the base section of the handle assembly within the interior compartment of the enclosures with a plurality of mounting screws. Further, the line and load blades are secured to the handle assembly with a plurality of mounting screws. This method of assembly requires that an inventory of screws be maintained and controlled for this operation. Additionally, proper production tooling, e.g. screw guns, must be used. For these reasons the use of screws adds significant cost and labor to the production process.

BRIEF SUMMARY OF THE INVENTION

In an exemplary embodiment of the invention, an electric disconnect switch assembly is mounted within a disconnect enclosure for manually disconnecting electrical equipment from a source of supply power. The electric disconnect switch assembly includes a receptacle and a handle assembly. The receptacle is attached to a bottom wall of the enclosure. The receptacle includes a load stab arranged in a first pocket and in contact with a load terminal lug and a line stab arranged in a second pocket and in contact with a line terminal lug. The handle assembly includes a handle grip projecting from one end and a line blade and a load blade extending from an opposite end thereof. The handle assembly is slidably arranged within the receptacle and the line blade and the load blade are moved into and out of contact with the line and load stabs by manual operation of the handle grip.

DETAILED DESCRIPTION OF THE INVENTION

Figure 1:
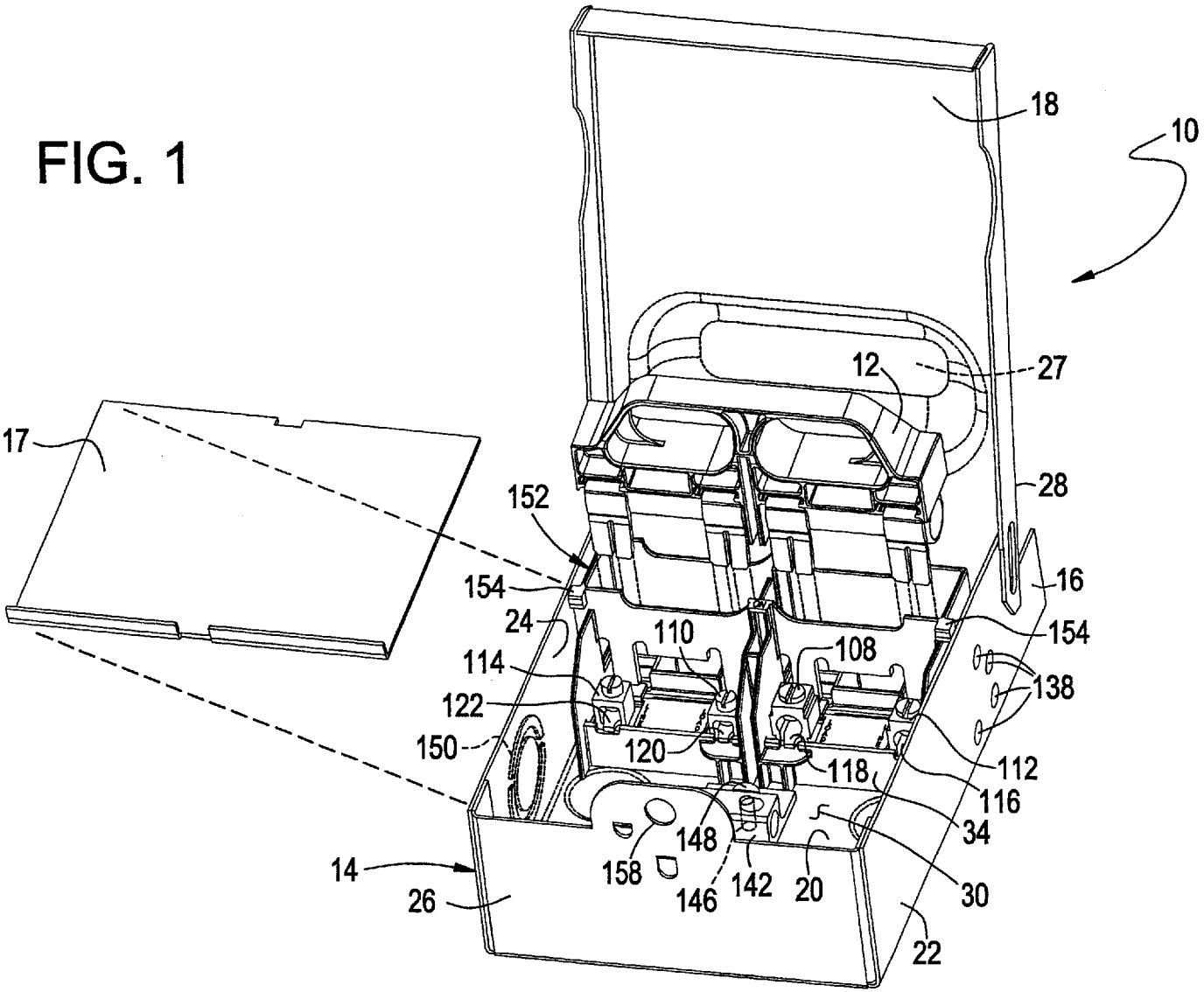
FIG. 1 is a perspective view of a fully assembled disconnect embodying the present invention.

Referring to FIG. 1 a perspective view of an exemplary embodiment of a fully assembled disconnect, such as used for air-conditioning or refrigeration equipment, is shown generally at 10. The disconnect 10 comprises an upstanding, pull-type handle assembly (handle assembly) 12 mounted within an insulative plastic receptacle (receptacle) 34. Receptacle 34 is fixedly attached to a disconnect enclosure 14. Handle assembly 12 forms part of a circuit (not shown) for providing electric current to electrically powered equipment (not shown). Handle assembly 12 serves to isolate the electrically powered equipment from a source of supply power, by enabling a user to manually break the circuit conducting the supply power to the equipment. The disconnect enclosure 14 comprises a base 16 hingedly attached to a separate cover 18. An oval recess 27 is integrally-formed within the cover 18 to provide clearance for an upstanding grip 76 of the handle assembly 12. An electric disconnect switch assembly is generally shown at 152 in the "ON" position and comprises the handle assembly 12 and receptacle 34.

Base 16 includes a bottom wall 20, with a first side wall 22 and a second side wall 24. First side wall 22 and second side wall 24 extend substantially perpendicular from opposing side boundaries of the bottom wall 20. Additionally, base 16 includes a front wall 26 and a rear wall 28, which extend substantially perpendicular from front and rear boundaries of the rear wall 20, respectively. The bottom wall 20, first side wall 22, second side wall 24, front wall 26 and rear wall 28 define an interior compartment 30 of the base 16 for mounting the handle assembly 12 therein.

Also attached to the bottom wall 20 of the enclosure 14, is the neutral terminal assembly 142 which includes a pair of neutral terminal screws 146. The neutral terminal assembly 142 is mechanically attached and electrically bonded to the disconnect enclosure 14 by means of a machine screw 148.

A plurality of knockouts 150 are cut within the front wall 26, first side wall 22 and second side wall 24. These knockouts allow for wiring access to the line terminal lugs 112, 114 and load terminal lugs 108, 110 contained within the electric disconnect switch assembly 152.

Figure 2:
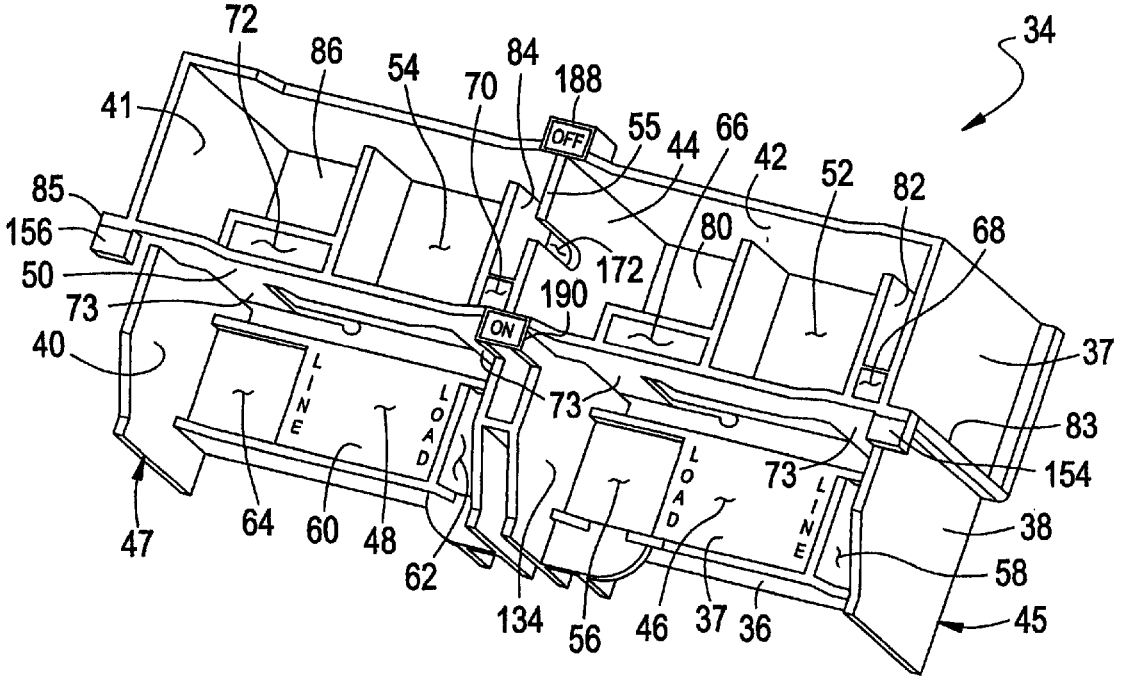
FIG. 2 is an isometric view of the receptacle of FIG. 1.

Referring to FIG. 2, receptacle 34 is shown having a base section 36, a first side 37, a second side 41, a third side 38, and a fourth side 40, and a rear side 42. First side 37 extends generally perpendicularly outward from an end of rear side 42. Second side 41 extends generally perpendicularly outward from an opposing end of rear side 42. A first partition wall 50 having a first outer edge 83 and a second outer edge 85 extends longitudinally between the first and second sides 37, 41. A second partition wall 44 is generally parallel to first and second sides 37, 41. Second partition wall 44 includes an elongated slot 172 located at a top end 55, preferably centrally located at the top end 55. First side 37, rear side 42, second partition wall 44 and first partition wall 50 define a first compartment 52. Second side 41, rear side 42, second partition wall 44 and first partition wall 50 define a second compartment 54 adjacent to first four-sided compartment 52. Preferably, first and second compartments 52, 54 are four-sided and similar in size and shape.

Third side 38 extends outward from first partition wall 50 a distance designated by "d1" from first outer edge 83. Third side 38 is parallel to first side 37. Fourth side 40 extends from first partition wall 50 a distance designated by "d2" from second outer edge 85. Fourth side 40 is parallel to second side 41. Preferably, "d2" is equal to "d1".

A double partition wall 134 extends generally perpendicularly outward from first partition wall 50 over base section 36 and parallel to second and third sides 38, 40. Double partition wall 134, third side 38 and first partition wall 50 define a third compartment 46. Double partition wall 134, fourth side 40 and first partition wall 50 define a fourth compartment 48. Double partition 134 is proximate the load terminal lugs 108, 110 (FIG. 1) and serve as insulative barriers. Third side 38 and fourth side 40 are proximate the line terminal lugs 112, 114, (FIG. 1) respectively and serve as insulative barriers.

Base section 36 extends through the first, second, third and fourth compartments 52, 54, 46, 48. Base section 36 extending through third and fourth compartments 46, 48 includes a top surface 60, preferably planar, facing in the direction of the interior of the cover 18 (FIG. 1) when the cover 18 is in the closed position (not shown).

A first recess 56 is located on top surface 60 in third compartment 46 proximate to double partition wall 134. A second recess 58 is located on top surface 60 in third compartment 46 proximate to third side 38. A third recess 62 is located on top surface 60 in fourth compartment 48 proximate to double partition wall 134. A fourth recess 64 is located on top surface 60 in fourth compartment 48 proximate to fourth side 40. Proximate to both the first recess 56 and third recess 62 are two marks with the word "Load." Proximate to both the second recess 58 and fourth recesses 64 are accordingly marked with the word "Line". The "Line" and "Load" indicia are formed integral with the forming of the receptacle 34 and are permanently affixed therein.

A first pocket 66 is molded in first compartment 52 proximate to second partition wall 44 and in the same general plane as base section 36. A second pocket 68 is similarly formed in first compartment 52 proximate to first side 37. A third pocket 70 is similarly formed in second four-sided compartment 54 proximate to second partition wall 44. A fourth pocket 72 is similarly formed in second compartment 54 proximate to second side 41. Preferably, first, second, third and fourth pockets 66, 68, 70, 72 are similar in size and shape.

First partition wall 50 includes at least one, preferably four, fingers 73 extending inwardly and between first recess 56 and first pocket 66, between second recess 58 and second pocket 68, between third recess 62 and third pocket 70 and finally, between fourth recess 64 and fourth pocket 72.

Base section 36 also includes a first opening 80 that is located in the first compartment 52 between first pocket 66 and rear side 42. A second opening 82 is located in the first compartment 52 between the second pocket 68 and the rear side 42. A third opening 84 is located in the second compartment 54 between the third pocket 70 and the rear side 42. A fourth opening 86 is located in the second compartment 54 between the fourth pocket 72 and the rear side 42. Preferably, first, second, third and fourth openings 80, 82, 84, 86 are rectangularly shaped and similar in size.

A first tab 188 extends outward from the top of the rear wall 42 proximate second partition wall 44. A second tab 190 extends outward from the top of first partition wall 50 proximate to the double wall partition 134 and opposite to the first tab 188.

Figure 3:
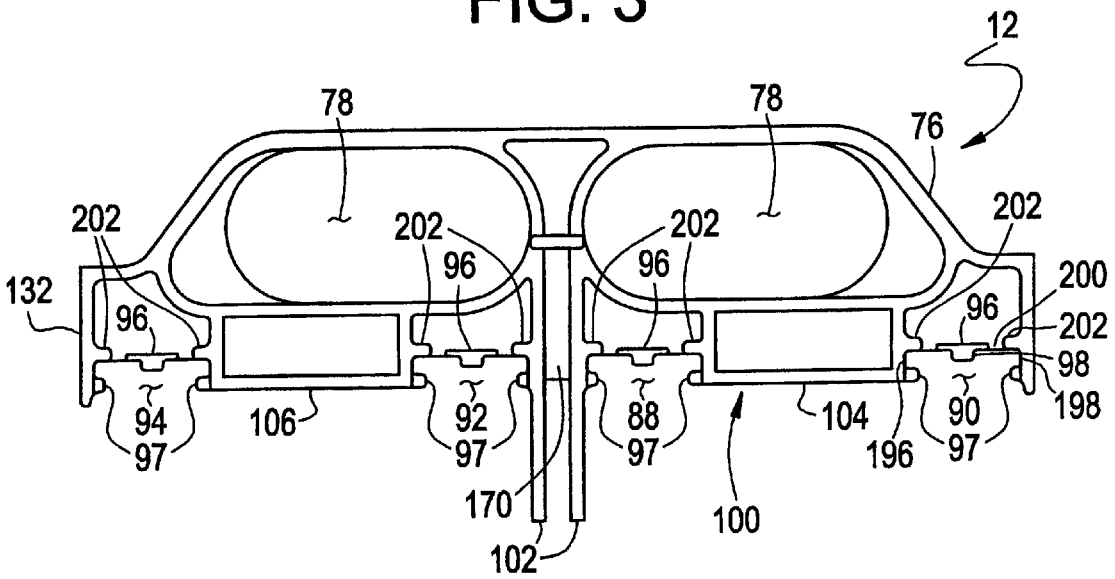
FIG. 3 is a cross-sectional view of the handle assembly of FIG. 1.

Referring to FIG. 3, handle assembly 12 is shown having grip 76 and a handle base 132 with a bottom surface, preferably planar, generally indicated at 100 that faces in the direction of bottom wall 20 (FIG. 1). Handle base 132 also includes a first end 45 and a second end 47. Grip 76 includes an aperture 78, preferably two apertures 78, which an operator can utilize to manually position the handle assembly 12 within the plastic receptacle 34 (FIG. 1). Handle assembly 12 also includes two protruding fins 102 separated by a fin 170 extending perpendicularly between. Fins 102 extend from a central point within the grip and partition the bottom surface 100. Fins 102 partition the bottom surface 100 into a first bottom surface 104, preferably planar, and a second bottom surface 106, preferably planar.

Referring to FIG. 3, the handle base 132 section of the handle assembly 12 will be discussed.

First cavity 88 is positioned in first bottom surface 104 of the handle base 132 proximate the fin 102. A second cavity 90 is positioned in first bottom surface 104 proximate to the end of the first bottom surface 104. A third cavity 92 is positioned in second bottom surface 106 proximate fin 102. A fourth cavity 94 is positioned in second bottom surface 106 proximate to the end of the second bottom surface 106. First, second, third and fourth cavities 88, 90, 92, 94 each having opposing sidewalls 196, 198 with a planar wall 200 partially connecting the opposing sidewalls 196, 198 and facing base 20 (FIG. 1). Preferably, first, second, third and fourth cavities 88, 90, 92, 94 are rectangular in shape.

Figure 4:
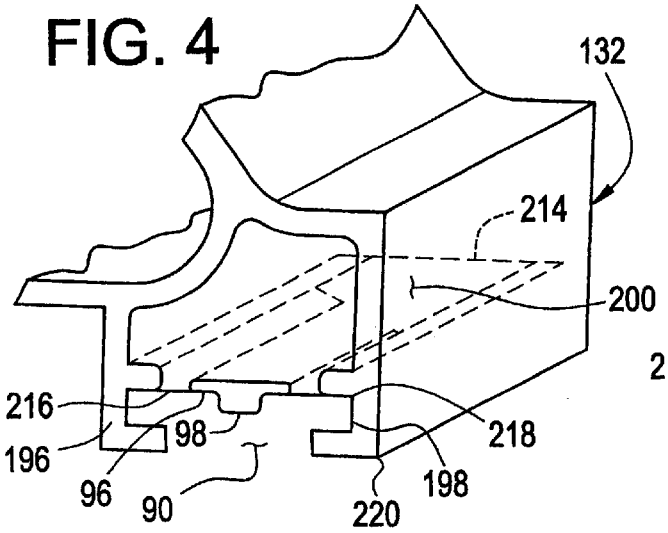
FIG. 4 is an enlarged cross sectional of a portion of the handle base of the handle assembly.
Figure 5:
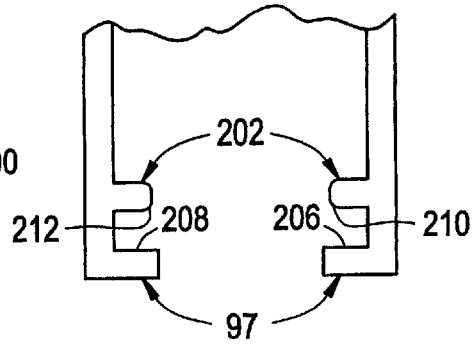
FIG. 5 is a cross sectional view of the portion of the handle base of FIG. 4.

Referring to FIGS. 3, 4 and 5, the features of the first, second, third and fourth cavities 88, 90, 92, 94 will be discussed in further detail in relation to the second cavity 90 of the handle base 132. FIG. 4 is an enlarged view of a second cavity 90 located within the handle base 132. FIG. 5 is a cross-section of the second cavity 90. Although the discussion below details the configuration of the second cavity, it is understood that the first, third and fourth cavities 88, 92, 94 are similar.

Planar wall 200 includes a first end 214 and a second end 216. Opposing sidewalls 196, 198 include a top end 218 and a bottom end 220. First, second, third and fourth cavities 88, 90, 92, 94 each include a member 96, preferably cantilevered, with a boss 98. Preferably, member 96 is an integrally formed extension of planar wall 200. Boss 98 is located at the second end (free end) 216 of the member 96. The opposing sides of the first, second, third and fourth cavities 88, 90, 92, 94 also each include a first and second pair of ribs 97, 202. First pair of ribs 97 includes a first rib 206 and a second rib 208. First rib 206 and second rib 208 are integrally formed along the opposing sidewalls 96, 98 and generally extend in a cross-wise direction. First and second ribs 206, 208 are located proximate to the bottom ends 220 of the opposing sidewalls 96, 98. Preferably, first rib 206 is parallel to and opposite second rib 208 and first and second ribs 206, 208 extend from first end 214 of the second cavity 90 but not all the way through to the second end 216. Second pair of ribs 202 includes a third rib 210 and a fourth rib 212. Third and fourth ribs 210, 212 are integrally formed along the opposing sidewalls 96, 98 and extend in a generally cross-wise direction. Preferably, third and fourth ribs 210, 212 are parallel to first and second ribs 206, 208 and are located proximate the top ends 218 of the opposing sidewalls 96, 98. Most preferably, third and fourth ribs 210, 212 are the same general length as the member 96.

Figure 6:
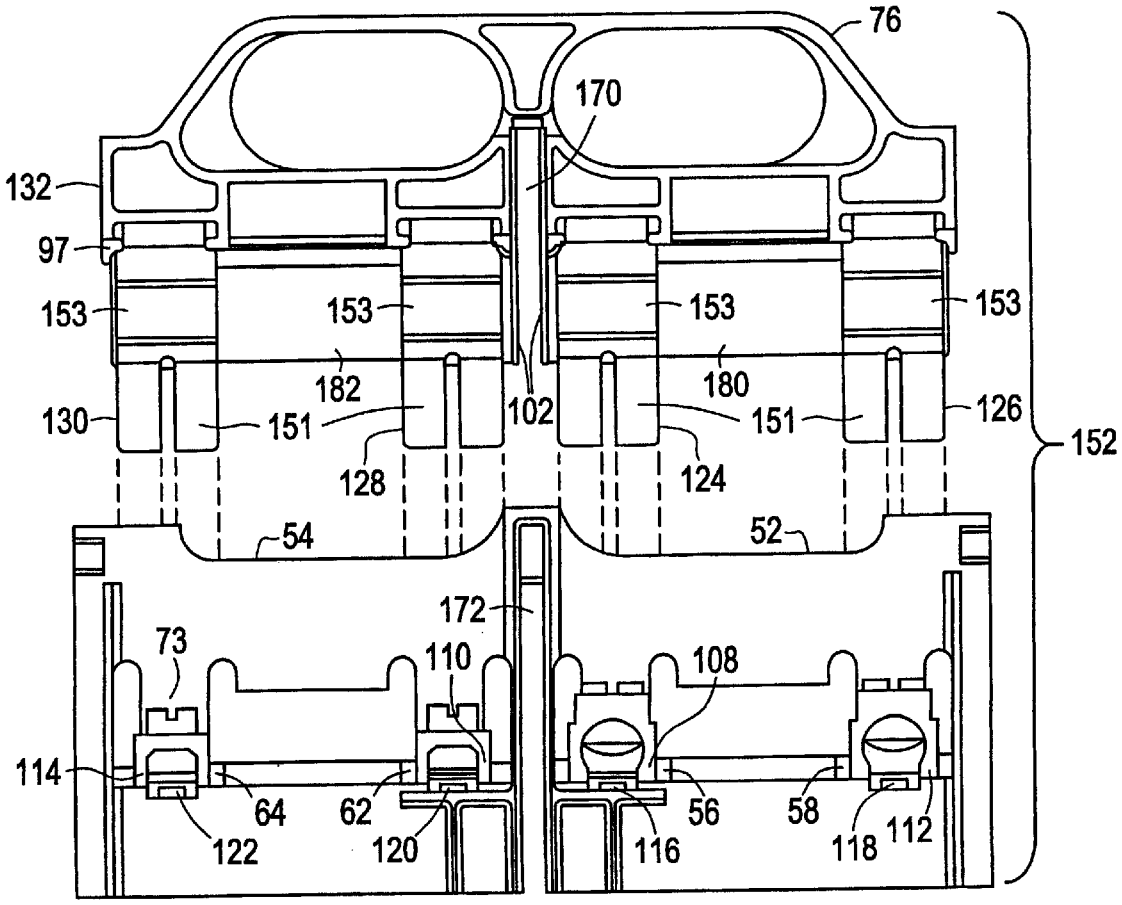
FIG. 6 is a cross-sectional front view of the electric disconnect switch assembly of FIG. 1.

Referring to FIGS. 1 and 6, the operation and assembly of the electric disconnect switch assembly 152 within the disconnect enclosure will be detailed.

The receptacle 34 is mounted within disconnect enclosure 14 by the use of at least one, preferably two or four dimples 136 that extend inward. Dimples 136 are punched into the first side wall 22 and second side wall 24 of the disconnect enclosure 14, generally towards the rear wall 28. Two ledges 140 are integrally formed and located along the bottom of first side 37 and second side 41 and serve to anchor the receptacle by sliding the ledges 140 under the dimples 136.

An insulative plastic dead-front or shield 17, preferably planar, is arranged over the electrical components on the electric disconnect switch assembly 152 by positioning the corners of the shield 17, under a corresponding pair of tabs 154 formed on the first partition wall 50 of the receptacle 34 and overlaying the shield 17 onto the top portion of double partition 134. The opposite end of the shield 17 rests on an inwardly extending horizontal tab 158 which is formed within the front wall 26 of the disconnect enclosure 14.

The pair of load terminal lugs 108, 110 is positioned within first recess 56 and third recess 62, respectively. The pair of line terminal lugs 112, 114 is positioned within second recess 58 and fourth recess 64, respectively. The load terminal lugs 108, 110 are mechanically and electrically connected to a corresponding pair of load stabs 116, 120. The line terminal lugs 112, 114 are mechanically and electrically connected to a corresponding pair of line stabs 118, 122.

A first blade (first load blade) 124 is slidably and releasably engaged (snap-fit) between the first and second pair of ribs 97, 202 located on first sidewall 196 and second sidewall 198. The first blade 124 is additionally supported by boss 98 (FIG. 3). Similarly, a second blade (first line blade) 126 is slidably and releasably engaged into second cavity 90, a third blade (second load blade) 128 is slidably and releasably engaged into third cavity 92 and a fourth blade (second line blade) 130 is slidably and releasably engaged into fourth cavity 94. First, second, third and fourth blades 124, 126, 128, 130 each having an elongated slotted section 151 formed on one side. Preferably, first, second, third and fourth blades, 124, 126, 128, 130 also have a top section 153, preferably U-shaped, slidably mounted between the first and second pair of ribs 97, 202.

A first fuse 180 snap-fits between the first blade 124 and the second blade 126. A second fuse 182 snap-fits between the third blade 128 and the fourth blade 130. First fuse 180 and second fuse 182 are thus positioned in a horizontal arrangement and end to end along the bottom surface 100 of the handle assembly 12.

Handle base 132 of the operator handle 14 with the first, second, third and fourth blades 124, 126, 128, 130 attached thereto fit within first compartment 52 and second compartment 54. Fins 102 serve as a guide for positioning the operator handle 14 within the receptacle 34. Fins 102 are spaced sufficiently apart so as to be positioned proximate to second partition wall 44 (FIG. 2). The fin 170 will rest on the bottom edge of slot 172 to ensure that the grip 76 extends outward from the first and second compartments 52, 54 to facilitate operating the operator handle 14. Thus, when assembled, the base section 132 mounts flush with the interior surfaces of first side 37, second side 41, rear side 42 and first partition wall 50.

When the operator handle 14 is fully positioned within the receptacle 34 in the "ON" position, the first, second, third and fourth blades 124, 126, 128, 130 provide continuity between the line terminal lugs 112, 114 and the load terminal lugs 108, 110. More specifically, the elongated slotted section 151 of first, second, third and fourth blades 124, 126, 128, 130 is positioned proximate to the pair of line stabs 118, 122 and load stabs 116, 120 within first, second, third and fourth pockets 66, 68, 70, 72, respectively.

Fingers 73 provide an insulative barrier for the first, second, third and fourth blades 124, 126, 128, 130. Electrical continuity is provided when the elongated slotted section 151 of the first and second blades 124, 126 are inserted into first and second pockets 66, 68 and third and fourth blades 128, 130 are inserted into third and fourth pockets 70, 72.

When the operator handle is removed from the receptacle 34, turned 180 degrees and reinserted into the receptacle 34 (the "off" position), again using fins 102 as a guide, continuity between the line terminal lugs 112, 114 and the load terminal lugs 108, 110 is interrupted. First, second, third, and fourth openings 80, 82, 84, 86 now contain third, fourth, first and second blades 128, 130, 124, 126, respectively.

Figure 7:
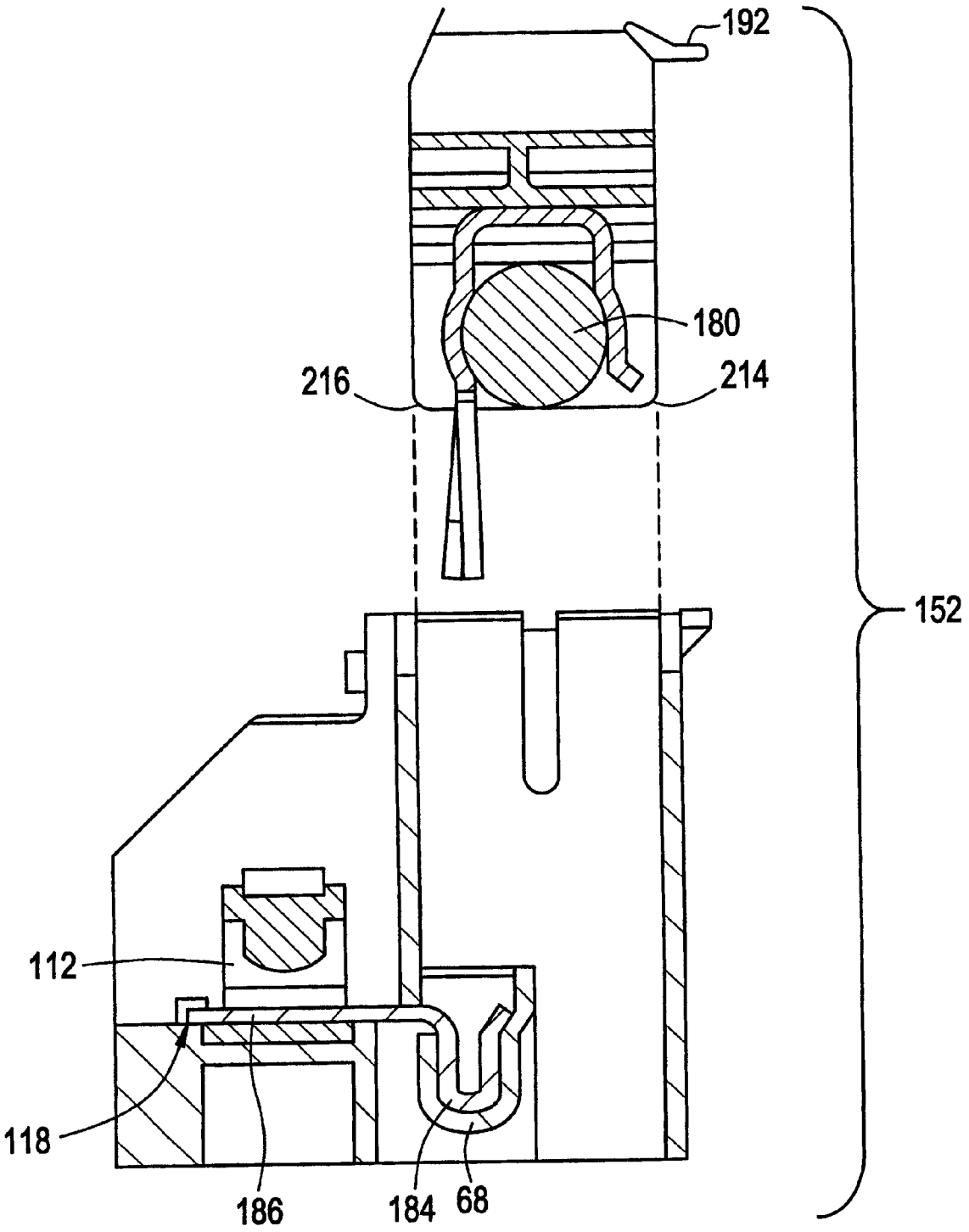
FIG. 7 is a cross-sectional end view of the electric disconnect switch assembly of FIG. 6.

Referring to FIG. 7, a side view of the electric disconnect switch assembly 152 is shown. Line stab 118 is shown having a bent section 184 and a flat section 186. Bent section 184, preferably U-shaped, is inserted into second pocket 68 and flat section 186 is inserted through line terminal lug 112.

Referring again to FIGS. 1 and 6, load stabs 116, 120 and line stab 122 are similarly constructed with the flat section 186 and bent section 184. Bent section 184 of line stab 122 is inserted into fourth pocket 72 and flat section 186 of line stab 122 is inserted through line terminal lug 114. Bent section 184 of load stab 116 is inserted into first pocket 66 and flat section 186 of load stab 116 is inserted through line terminal lug 108. Bent section 184 of load stab 120 is inserted into third pocket 70 and flat section 186 of load stab 120 is inserted through line terminal lug 110.

Referring to FIGS. 2 and 6, corresponding "OFF" indicia is integrally-formed within first tab 188 and "ON" indicia is formed within the opposing second tab 190, as indicated in FIG. 2. To provide a clear indication of the position of the first, second, third and fourth blades 124, 126, 128, 130 with respect to the corresponding line and load stabs 116, 118, 120, 122, an indicating tab 192 centrally located on the grip 76 of the handle assembly 12 is employed. Indicating tab 192 interacts with the first and second tabs 188, 190 in the following manner. When the electric switch assembly 152 is in its "ON" condition, the elongated slotted sections 151 of each of the first, second, third and fourth blades 124, 126, 128, 130 are inserted within the first, second, third and fourth pockets 66, 68, 70, 72, respectively, and electrical connection is made between the adjacent load and line stabs 116, 118, 120, 122. The indicating tab 192 overlaps and covers the first tab 188 thereby concealing the "OFF" indicia contained thereon. The "ON" indicia located on the opposing second tab 190 is readily visible.

In like manner, when the electric switch assembly 152 is in its "OFF" condition such that the elongated slotted sections 151 of each of the first, second, third and fourth blades 124, 126, 128, 130 are inserted within the fourth, third, second and first four-sided rectangular openings 86, 84, 82, 80, respectively, the indicating tab 192 conceals the "ON" indicia located on the second tab 190 such that the "OFF" indicia located on first tab 188 is readily visible. Thus, without removing the handle assembly 12 from the electric switch assembly 152, the operator can quickly determine by visual inspection whether the electric switch assembly 152 is in the "ON" or "OFF" position.

As described herein, the electric switch assembly 152 reduces parts since the base and guide sections of the receptacle 34 are integrally molded to form one piece. Further, the need for mechanical fasteners to connect the first, second, third and fourth blades 124, 126, 128, 130 to the handle assembly 12 is eliminated. Thus, assembly time and material costs are reduced. The first and second fuses 180, 182 snap-fit within the first, second, third and fourth blades 124, 126, 128, 130 and are arranged horizontally and end to end along the bottom surface 100 of the handle assembly 12. The efficient placement of the first and second fuses 180, 182 reduces the size requirement of the disconnect enclosure 14. A reduction in the overall size of the disconnect enclosure 14 permits a wider use of the product in the field. Finally, the electric disconnect switch assembly 152 also reduces the amount of copper and plastic used. This reduction in raw material, while maintaining the necessary strength and temperature characteristics to meet UL requirements, results in material cost savings.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the overall inventive concepts described herein.

What is claimed is:

1. An electric disconnect switch assembly mounted within a disconnect enclosure for manually disconnecting electrical equipment from a source of supply power, the electric disconnect switch assembly comprising:

a receptacle attached to the disconnect enclosure, said receptacle including a line stab and a load stab, said load stab arranged in a first pocket and in contact with a load terminal lug, said line stab arranged in a second pocket and in contact with a line terminal lug; and a handle assembly including:

a grip projecting from one end and a first line blade and a load blade extending from an opposite end thereof, said handle assembly being slidably arranged within said receptacle and wherein said first line blade and said first load blade are moved into and out of contact with said line and load stabs by manual operation of said grip, a handle base integrally molded with said grip and having a bottom surface, first end and a second end, and a first cavity formed within said bottom surface having a first pair of ribs formed in a pair of opposing sidewalls of said first cavity, wherein said first pair of ribs restrain movement of said first load blade when said first load blade is mounted within said first cavity.

2. The electric disconnect switch assembly of claim 1 wherein said first cavity includes:

a first member extending outward from said handle base into said first cavity proximate to said first load blade and generally parallel to said first pair of ribs; and a first boss integrally molded to said first member proximate to said first load blade, said first member and said first boss releasably arranged to fixedly support said first load blade.

3. The electric disconnect switch assembly of claim 2 wherein said first member is cantilevered, said first member extending outward from a planar wall of said handle base and said first boss is positioned at a free end of said first member.

4. The electric disconnect switch assembly of claim 2 wherein said first cavity includes:

a second pair of ribs formed in said opposing sidewalls of said first cavity proximate said first member;

wherein said second pair of ribs restrain movement of said first load blade when said first load blade is slidably mounted between said first pair of ribs of said first cavity and said second pair of ribs of said first cavity.

5. The electric disconnect switch assembly of claim 4 wherein said first pair of ribs of said first cavity is generally parallel to said second pair of ribs of said first cavity.

6. The electric disconnect switch assembly of claim 1 further comprising:

a second cavity formed within said bottom surface having a first pair of ribs formed in a pair of opposing sidewalls of said second cavity, wherein said first pair of ribs of said second cavity restrain movement of said first line blade when said first line blade is mounted within said second cavity.

7. The electric disconnect switch assembly of claim 6 wherein said second cavity includes:

a second member extending outward from said handle base into said second cavity proximate to said first line blade and generally parallel to said first pair of ribs of said second cavity; and a second boss integrally molded to said second member proximate to said first line blade, said second member and said second boss releasably arranged to fixedly support said first line blade.

8. The electric disconnect switch assembly of claim 7 wherein said second member is cantilevered, said second member extending outward from a planar wall of said handle base and said second boss is positioned at a free end of said second member.

9. The electric disconnect switch assembly of claim 7 wherein said second cavity includes:

a second pair of ribs formed in said opposing sidewalls of said second cavity proximate said second member;

wherein said second pair of ribs of said second cavity restrain movement of said first line blade when said first line blade is slidably mounted between said first pair of ribs of said second cavity and said second pair of ribs of said second cavity.

10. The electric disconnect switch assembly of claim 9 wherein said first pair of ribs of said second cavity is generally parallel to said second pair of ribs of said second cavity.

11. The electric disconnect switch assembly of claim 6 wherein said first cavity is located proximate to the center of said handle base and said second cavity is located proximate to an outer end of said handle base.

12. The electric disconnect switch assembly of claim 1 wherein said receptacle includes:

a molded base section having a top surface;

a rear side;

a first side extending generally perpendicularly outward from an end of said rear side;

a second side extending generally perpendicularly outward from an opposing end of said rear side;

a first partition wall having a first outer edge and a second outer edge extending longitudinally between said first and second sides; and a second partition wall generally parallel to said first and second sides, said second partition wall, said rear side, said first partition wall, and said first side defining a first compartment and said second partition wall, said rear side, said first partition wall, and said second side defining a second compartment.

13. The electric disconnect switch assembly of claim 12 further comprising:

a pair of protruding fins extending downward from said handle base in a direction opposite said grip;

a fin extending partially lengthwise between said pair of protruding fins; and an elongated slot formed on a top end of said second partition wall, said fin captured within said elongated slot to slidably arrange said handle assembly within said receptacle.

14. The electric disconnect switch assembly of claim 13 wherein said pair of protruding fins are parallel and said fin extends perpendicularly to said pair of protruding fins.

15. The electric disconnect switch assembly of claim 12 wherein said first partition wall includes a finger extending downward and proximate to said line or first load blades.

16. The electric disconnect switch assembly of claim 12 further comprising:

a double wall partition extending generally perpendicular from said first partition wall dividing said base section into a third compartment and a fourth compartment.

17. The electric disconnect assembly of claim 16 wherein said third compartment includes:

a first recess within said top surface and proximate said double wall partition; and a second recess within said top surface and proximate said second side.

18. The electric disconnect switch assembly of claim 17 further comprising:

a first pocket molded in said first compartment proximate to the intersection of first and second partition walls and in the same general plane as said base section; and a second pocket molded in said first compartment proximate to the intersection of said first side and said first partition wall and in the same general plane as said base section;

wherein said load terminal lug is positioned within said first recess and said line terminal lug is positioned within said second recess and said load stab is positioned within said first pocket and through said load terminal lug and said line stab is positioned within said second pocket and through said line terminal lug.

19. The electric disconnect switch assembly of claim 18 further comprising:

a first opening between said first pocket and said rear side; and a second opening between said second pocket and said rear side;

wherein said first opening and said second opening is arranged to accept said first line and load blades when the handle assembly is in an "OFF" position.

20. An electric disconnect switch assembly mounted within a disconnect enclosure for manually disconnecting electrical equipment from a source of supply power, the electric disconnect switch assembly comprising:

a receptacle attached to the disconnect enclosure, said receptacle including a line stab and a load stab, said load stab arranged in a first pocket and in contact with a load terminal lug, said line stab arranged in a second pocket and in contact with a line terminal lug;

a handle assembly including a grip projecting from one end and a first line blade and a load blade extending from an opposite end thereof, said handle assembly being slidably arranged within said receptacle and wherein said first line blade and said first load blade are moved into and out of contact with said line and load stabs by manual operation of said grip;

a first tab and a second tab extending from said receptacle; and an indicating tab extending from one side of said handle assembly;

wherein "ON" and "OFF" indicia within said first and second tabs become selectively covered and exposed by said indicating tab to display a relationship between said line and load stabs and said first line and load blades.

21. An electric disconnect switch assembly mounted within a disconnect enclosure for manually disconnecting electrical equipment from a source of supply power, the electric disconnect switch assembly comprising:

a receptacle attached to the disconnect enclosure, said receptacle including a line stab and a load stab, said load stab arranged in a first pocket and in contact with a load terminal lug, said line stab arranged in a second pocket and in contact with a line terminal lug;

a handle assembly including:

a grip projecting from one end and a first line blade and a load blade extending from an opposite end thereof, said handle assembly being slidably arranged within said receptacle and wherein said first line blade and said first load blade are moved into and out of contact with said line and load stabs by manual operation of said grip, a handle base integrally molded with said grip and having a bottom surface, wherein said first load blade includes a first bent section, said first bent section attached to said bottom surface of said handle base and said first line blade includes a second bent section, said second bent section attached to said bottom surface of said handle base, said first line blade longitudinally aligned with said first load blade; and a first fuse releasably engaged between said first bent section of said first load blade and said second bent section of said first line blade.

22. The electric disconnect switch assembly of claim 21 further comprising:

a second load blade having a first bent section, said first bent section attached to said bottom surface of said handle base;

a second line blade having a second bent section, said second bent section attached to said bottom surface of said handle base, said second line blade longitudinally aligned with said second load blade; and a second fuse releasably engaged between said first bent section of said second load blade and said second bent section of said second line blade;

wherein said second fuse aligned longitudinally end to end with said first fuse.

23. A disconnect for manually disconnecting electrical equipment from a source of supply power, the disconnect comprising:

an enclosure having an interior compartment;

a cover fixedly connected to said enclosure and sized to enclose said interior compartment; and an electric disconnect switch assembly including:

a receptacle attached to said enclosure, said receptacle including a line stab and a load stab, said load stab arranged in a first pocket and in contact with a load terminal lug, said line stab arranged in a second pocket and in contact with a line terminal lug; and a handle assembly including:

a grip projecting from one end and a first line blade and a first load blade extending from an opposite end thereof, said handle assembly being slidably arranged within said receptacle and wherein said first line blade and said first load blade are moved into and out of contact with said line and load stabs by manual operation of said grip, a handle base integrally molded with said grip and having a bottom surface, first end and a second end, and a first cavity formed within said bottom surface having a first pair of ribs formed in a pair of opposing sidewalls of said first cavity, wherein said first pair of ribs restrain movement of said first load blade when said first load blade is mounted within said first cavity.

24. The disconnect of claim 23 wherein said first cavity includes:

a first member extending outward from said handle base into said first cavity proximate to said first load blade and generally parallel to said first pair of ribs; and a first boss integrally molded to said first member proximate to said first load blade, said first member and said first boss releasably arranged to fixedly support said first load blade.

25. The disconnect of claim 24 wherein said first member is cantilevered, said first member extending outward from a planar wall of said handle base and said first boss is positioned at a free end of said first member.

26. The disconnect of claim 23 wherein said first cavity includes:

a second pair of ribs formed in said opposing sidewalls of said first cavity proximate said first member;

wherein said second pair of ribs restrain movement of said first load blade when said first load blade is slidably mounted between said first pair of ribs of said first cavity and said second pair of ribs of said first cavity.

27. The disconnect of claim 28 wherein said first pair of ribs is parallel to said second pair of ribs.

28. A disconnect for manually disconnecting electrical equipment from a source of supply power, the disconnect comprising:

an enclosure having an interior compartment;

a cover fixedly connected to said enclosure and sized to enclose said interior compartment;

an electric disconnect switch assembly including:

a receptacle attached to said enclosure, said receptacle including a line stab and a load stab, said load stab arranged in a first pocket and in contact with a load terminal lug, said line stab arranged in a second pocket and in contact with a line terminal lug;

a handle assembly including a grip projecting from one end and a first line blade and a first load blade extending from an opposite end thereof, said handle assembly being slidably arranged within said receptacle and wherein said first line blade and said first load blade are moved into and out of contact with said line and load stabs by manual operation of said grip; and a shield supported by said receptacle and arranged over the line and load stabs to prevent inadvertent contact with the line and load stabs when said electric disconnect switch assembly is energized.

29. The disconnect of claim 28 wherein said shield is planar.

* * * * *